United States Patent [19]

Robinson

[11] 4,094,171

[45] June 13, 1978

[54] METHOD OF KNITTING A SWEATER BLANK

[75] Inventor: Frank Robinson, Breaston, England

[73] Assignee: Courtaulds Limited, London, England

[21] Appl. No.: 825,972

[22] Filed: Aug. 19, 1977

[30] Foreign Application Priority Data

Aug. 24, 1976 United Kingdom ..... 35155/76

[51] Int. Cl.[2] ..... A41B 9/06

[52] U.S. Cl. ..... 66/176

[58] Field of Search ..... 66/174, 175, 176

[56] References Cited

U.S. PATENT DOCUMENTS

| | | | |
|---|---|---|---|
| 3,702,068 | 11/1972 | Betts et al. | 66/176 |
| 3,813,901 | 6/1974 | Betts et al. | 66/176 XA |
| 3,882,697 | 5/1975 | Betts et al. | 66/176 |
| 3,956,908 | 5/1976 | Betts et al. | 66/176 |

*Primary Examiner*—Ronald Feldbaum

*Attorney, Agent, or Firm*—Davis, Hoxie, Faithfull & Hapgood

[57] ABSTRACT

A method of knitting a blank for a sleeved jacket or cardigan having overlapping front body panels, on a knitting machine with opposed needle beds containing independently operable needles. The method includes the steps of knitting a set of sleeve fabrics for the blank on the two opposed needle beds and knitting a set of body fabrics for the blank on the two opposed needle beds, the body fabrics comprising two front body panels and a rear body panel. The method also includes the step, in knitting one of the sets of fabrics, of taking needles out of action progressively on both needle beds in an inwards direction from both ends of the bank of operative needles of the knitting machine, and holding loops on the needles taken out of action, and the step, in knitting the other of the sets of fabrics, of bringing the needles made inactive progressively back into knitting action in outwards directions towards the ends of the bank of operative needles of the machine thereby causing wales of the sleeve fabrics to be inclined to wales of the body fabrics in the blank, and also the steps, in knitting the body fabrics, of knitting one front body panel before the other, casting this one body panel at least partly off the needles before knitting the other body panel and knitting this other body panel partly on needles already used to knit said one body panel to form a garment blank with overlapping front panels.

3 Claims, 1 Drawing Figure

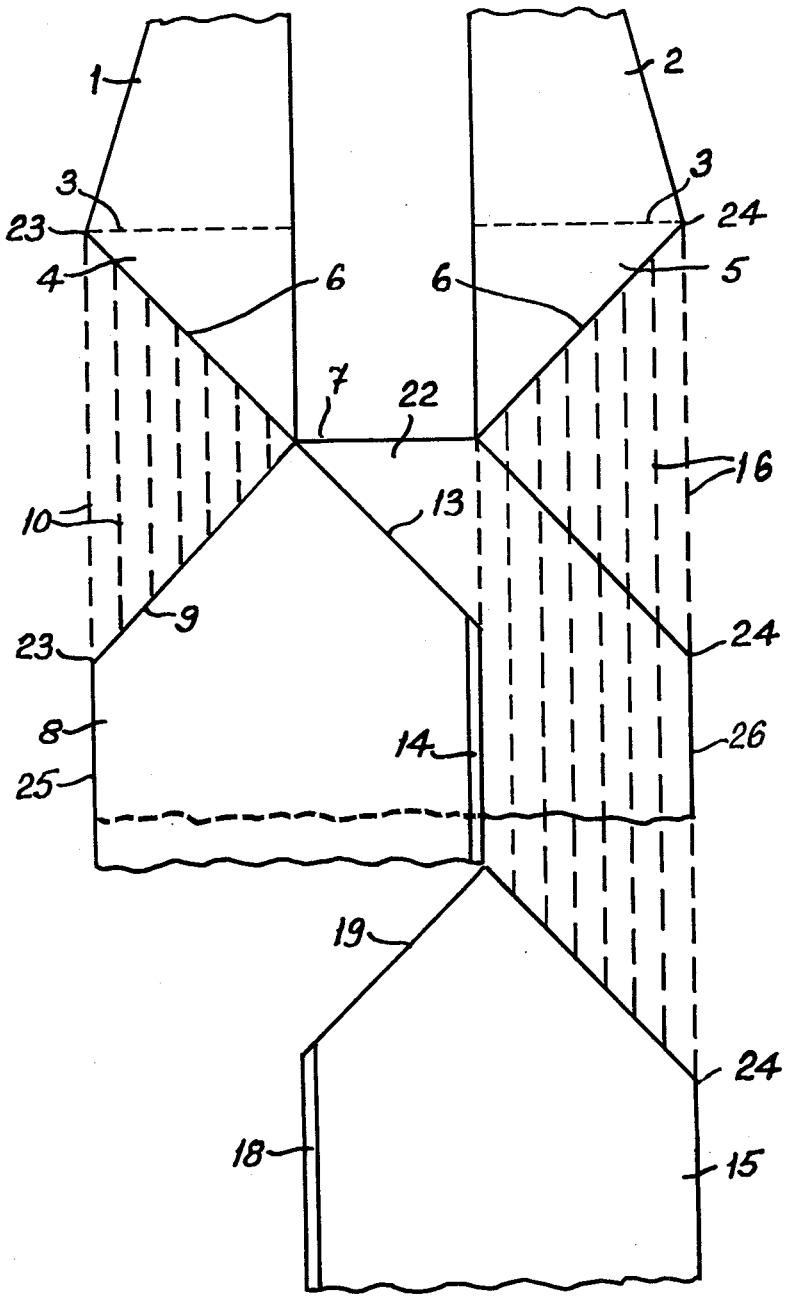
1
2
3
3
23
24
4
6
6
5
7
22
16
10
13
9
23
24
8
14
26
25
19
24
18
15

METHOD OF KNITTING A SWEATER BLANK

This invention relates to a method of knitting a blank for a sleeved jacket or cardigan with overlapping front panels, and to a garment made up from the blank.

In the methods of producing knitted garments currently in general use in knitting factories, a number of separate garment panels are knitted and are subsequently made up into a garment. The present invention is concerned with reducing the number of making up operations involved in producing a jacket or cardigan having overlapping front panels and thereby making possible a reduction in the cost of producing such garments.

According to the invention, a method of knitting a blank for a sleeved jacket or cardigan having overlapping front body panels, on a knitting machine with opposed needle beds containing independently operable needles, includes the steps of knitting a set of sleeve fabrics for the blank on the two opposed needle beds and knitting a set of body fabrics for the blank on the two opposed needle beds, the body fabrics comprising two front body panels and a rear body panel, the method also including the step, in knitting one of said sets of fabrics, of taking needles out of action progressively on both needle beds in an inwards direction from both ends of the bank of operative needles of the knitting machine, and holding loops on the needles taken out of action, and the step, in knitting the other of said sets of fabrics, of bringing the needles made inactive progressively back into knitting action in outwards directions towards the ends of the bank of operative needles of the machine thereby causing wales of the sleeve fabrics to be inclined to wales of the body fabrics in the blank, and further including the step, in knitting the body fabrics, of knitting one front body panel before the other, casting said one body panel at least partly off the needles before knitting the other body panel and knitting said other body panel partly on needles already used to knit said one body panel to form a garment blank with overlapping front panels.

The invention includes a garment blank made by the method just described and a garment made from the blank.

In carrying out the method just described, the body fabrics or the sleeve fabrics may be knitted first. In knitting the body fabrics, the front body panels are preferably, but not necessarily, knitted before the rear body panel. It is then possible to use the needles of both needle beds to knit a rib or tubular edging for the front body panels.

The invention will be further described, by way of example, with reference to the accompanying drawing in which the single Figure illustrates one embodiment of the method according to the invention.

The knitting method illustrated in the drawing is carried out on a knitting machine with opposed needle beds containing independently operable needles and in which knitting can be carried out on some needles whilst adjacent needles are maintained inactive but nevertheless continue to hold loops of the knitted fabric. An example of such a machine is that designated JDRPM and manufactured by the firm of Edouard Dubied & Cie. S.A., Switzerland. This machine is fitted with presser feet which push down the knitted fabric rather than pulling it down as do conventional take-down rollers.

Referring to the drawing, knitting may be begun at the extremities (not shown), for example the cuffs, of the sleeves 1 and 2 to form a set of fabrics constituting the sleeves of the garment blank on the opposed needle beds. The sleeves may be knitted in tubular form in which case the set of sleeve fabrics will comprise a pair of tubular sleeve fabrics.

Following on from tubular sleeve fabrics, at the course 3 in each sleeve 1 and 2, the cams and needles of the machine are operated to carry out knitting of U-shaped courses to form the shoulder regions 4 and 5 of the sleeves. The U-shaped courses of the two sleeves lie on the needle beds with the closed ends of the U-shapes adjacent one another and the open ends of the U-shapes located nearer the ends of the needle beds than the closed ends of the U-shapes.

As the knitting of the two groups of U-shaped courses proceeds, needles are taken out of action progressively on both needle beds of the machine in an inwards direction from both ends of the bank of operative needles. The needles taken out of action are, however, caused to retain their loops.

The U-shaped courses of the sleeve shoulder regions 4 and 5 thus become shorter, shaping these shoulder regions and forming a sleeve-body join line 6 at the front and rear of each sleeve.

When the neck line 7 of the garment blank is reached the knitting of U-shaped courses is stopped and knitting of a set of body fabrics for the garment on the two opposed needle beds is begun. In the present example, a right-hand front body panel 8 is the first of the body fabrics of the blank to be knitted. The panel 8 is knitted, in this example, on one only of the needle beds, for example the front bed of the knitting machine in the direction from the neck to the lower extremity (not shown) of the garment body. During knitting of the panel 8, needles of the front bed holding loops of the shoulder region 4 of the sleeve 1 are brought progressively back into action in an outwards direction on the needle bed away from the neck line 7 of the garment, thus joining loops of the panel 8 integrally to the loops of the shoulder region 4 held on those needles and forming a sleeve-body join line along which wales of the sleeve 1 are inclined to wales of the panel 8. The integral joining of the sleeve 1 and the panel 8 along the line 6 of the sleeve and the line 9 of the panel 8 is indicated in the drawing by the broken vertical lines 10.

In the present example, the panel 8 is also shaped along the line 13 by starting to knit the panel 8 using short courses of knitting and progressively bringing more needles into action in the direction towards the other sleeve. An edging 14 is also integrally formed, during knitting, along the free vertical edge of the panel 8. The edging may comprise a rib structure formed on both needle beds of the machine or a tubular structure also formed on both needle beds of the machine, in each case in a conventional manner.

On completion, the panel 8 is cast off the needles completely and knitting of a left-hand front body panel 15 is carried out in a similar manner to the knitting of the panel 8. The panel 15 is knitted so as to be integral with the shoulder region 5 of the sleeve 2 and the broken lines 16 indicate this integral joining. The progressive re-introduction to action of needles of the front needle bed holding sleeve loops in knitting the panel 15 causes wales of this panel to be inclined to wales of the sleeve 2 in the finished blank. The panel 15 is formed with an edging 18 and is shaped in the neck region along the line 19. On completion it is cast off the needles completely. Since the panel 8 has been cleared from the needles prior to knitting the panel 15, the latter panel can be knitted partly on needles already used to knit the panel 8 and the panels can thus be made large enough to overlap in the finished garment.

Knitting of a rear body panel 22 is then carried out to complete the set of body fabrics for the garment blank. Knitting of the panel 22 is begun along the neck line 7 and the first courses of the panel are made successively longer by bringing back into knitting action needles of the rear needle bed holding loops of the sleeve shoulder regions 4 and 5. The needles are brought back into action progressively in outward directions on the needle beds away from the neck line 7. When all the needles of the operative region on the machine, extending between the two underarm points 23 and 24 in the garment, have been brought back into action, the knitting of the panel 22 is continued to completion without, in the present example, further increasing the course length. The panel 22, and thus the blank, is cast off the needles.

In order to make a garment from the blank, the panels 8 and 22 and the panels 15 and 22 are seamed together up the sides 25 and 26 of the garment and fastenings are attached to the edgings 14 and 18. The lower extremities of the panels 8, 15 and 22 are also finished, for example by seaming or forming a welt.

If desired, the rear panel 22 may be knitted before the front panels 8 and 15 are knitted in succession. In that case the front panels are preferably not knitted with edging requiring use of the two needle beds in its formation since even if the rear panel 22 is cast off the needles, it will still be held in relation to the needles in such a manner that it may foul needles at the rear bed rising to take yarn.

The rear panel 22 may be knitted integrally with one of the two front panels 8 or 15 so that the two are continuous along one of the side seams 25 or 26. However, it cannot be knitted integrally with both front panels since the front panels must be knitted in succession, identical needles being used to knit parts of the two panels.

The method of the invention may also be carried out by knitting a garment blank starting from the lower extremity of the body and knitting in the direction towards the extremities of the sleeves. Thus, the front body panels 8 and 15 may be first knitted in succession followed by the rear body panel 22 and then the sleeves 1 and 2. The knitting of the shoulder regions of the blank follows a similar procedure to that described above but of course in the opposite direction. The body panels are completed first and needles taken out of action in knitting those panels are reintroduced in knitting the sleeve shoulder regions 4 and 5.

What is claimed is:

1. A method of knitting a blank for a sleeved jacket or cardigan having overlapping front body panels, on a knitting machine with opposed needle beds containing independently operable needles, said method including the steps of (a) knitting a set of sleeve fabrics for the blank on the two opposed needle beds, and (b) knitting a set of body fabrics for the blank on the two opposed needle beds, the body fabrics comprising two front body panels and a rear body panel, the method also including, (c) the step, in knitting one of said sets of fabrics, of taking needles out of action progressively on both needle beds in an inwards direction from both ends of the bank of operative needles of the knitting machine, and holding loops on the needles taken out of action, and (d) the step, in knitting the other of said sets of fabrics, of bringing the needles made inactive progressively back into knitting action in outwards directions towards the ends of the bank of operative needles of the machine thereby causing wales of the sleeve fabrics to be inclined to wales of the body fabrics in the blank, and further including (e) the step, in knitting the body fabrics, of knitting one of said front body panels before the other, casting one body panel at least partly off the needles before knitting the other body panel and knitting said other body panel partly on needles already used to knit said one body panel to form a garment blank with overlapping front panels.

2. A method as claimed in claim 1, wherein the front body panels are knitted in advance of the rear body panel and needles of both beds are used to knit a rib edging for said front body panels.

3. A method as claimed in claim 1, wherein the front body panels are knitted in advance of the rear body panel and needles of both beds are used to knit a tubular edging for said front body panels.

* * * * *